US007008918B2

(12) United States Patent
Lentsch et al.

(10) Patent No.: US 7,008,918 B2
(45) **Date of Patent: *Mar. 7, 2006**

(54) RINSE AGENT COMPOSITION AND METHOD FOR RINSING A SUBSTRATE SURFACE

(75) Inventors: Steven E. Lentsch, St. Paul, MN (US); Victor F. Man, St. Paul, MN (US); Yvonne M. Killeen, South St. Paul, MN (US)

(73) Assignee: Ecolab Inc., St. Paul, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/716,806

(22) Filed: Nov. 18, 2003

(65) Prior Publication Data

US 2004/0110660 A1 Jun. 10, 2004

Related U.S. Application Data

(63) Continuation of application No. 09/606,290, filed on Jun. 29, 2000, now Pat. No. 6,673,760.

(51) Int. Cl.
*C11D 3/37* (2006.01)

(52) U.S. Cl. ..... 510/514; 510/220; 510/234

(58) Field of Classification Search ..... 510/218, 510/219, 220, 221, 230, 234, 514
See application file for complete search history.

(56) References Cited

U.S. PATENT DOCUMENTS

| | | | |
|---|---|---|---|
| 4,260,528 | A | 4/1981 | Fox et al. |
| 5,273,677 | A | 12/1993 | Arif |
| 5,352,376 | A | 10/1994 | Gutzmann |
| 5,447,648 | A | 9/1995 | Steindorf |
| 5,501,815 | A | 3/1996 | Man |
| 5,516,452 | A | 5/1996 | Welch et al. |
| 5,534,199 | A | 7/1996 | Winkler, III |
| 5,545,352 | A | 8/1996 | Pike |
| 5,552,079 | A | 9/1996 | Roach et al. |
| 5,589,099 | A | 12/1996 | Baum |
| 5,602,093 | A | 2/1997 | Haerer et al. |
| 5,712,244 | A | 1/1998 | Addison et al. |
| 5,739,099 | A | 4/1998 | Welch et al. |
| 5,880,088 | A | 3/1999 | Lentsch et al. |
| 5,880,089 | A | 3/1999 | Lentsch et al. |
| 6,673,760 | B1 | 1/2004 | Lentsch et al. |

FOREIGN PATENT DOCUMENTS

| | | |
|---|---|---|
| GB | 2311537 A | 10/1997 |
| JP | 10017900 | 1/1998 |
| WO | WO 96/08553 | 3/1996 |
| WO | WO 96/10068 | 4/1996 |

*Primary Examiner*—John R. Hardee
(74) *Attorney, Agent, or Firm*—Merchant & Gould P.C.

(57) ABSTRACT

A rinse agent composition is provided. The rinse agent composition includes a sheeting agent for promoting draining of sheets of water from a surface, and a humectant. The humectant is a component which retains at least 5 wt. % water when the humectant has been contained at an equilibrium of 50% relative humidity and room temperature. The sheeting agent and humectant are preferably provided at a ratio of between about 5:1 and about 1:3. A method for rinsing a substrate surface in the presence of high solids containing water is provided. High solids containing water is generally considered to be water having a total dissolved solids content in excess of 200 ppm.

9 Claims, No Drawings

RINSE AGENT COMPOSITION AND METHOD FOR RINSING A SUBSTRATE SURFACE

This application is a continuation of U.S. application Ser. No. 09/606,290, filed Jun. 29, 2000, now U.S. Pat. No. 6,673,760. The entire disclosure of U.S. application Ser. No. 09/606,290 is incorporated herein by reference.

FIELD OF THE INVENTION

The invention relates to a rinse agent composition and to a method for rinsing a substrate surface. The composition and method are particularly useful with high solids containing water. The rinse agent composition includes a sheeting agent and a sufficient amount of a humectant for controlling the appearance of water solids on articles including cookware, dishware, flatware, glasses, cups, motor vehicle exteriors, hard surfaces, glass surfaces, etc.

BACKGROUND OF THE INVENTION

Mechanical warewashing machines have been common in the institutional and household environments for many years. Such automatic warewashing machines clean dishes using two or more cycles which can include initially a wash cycle followed by a rinse cycle. Such automatic warewashing machines can also utilize soak cycle, pre-wash cycle, scrape cycle, second wash cycle, rinse cycle, a sanitizing cycle, and drying cycle. Any of these cycles can be repeated, if desired, and additional cycles can be used. Rinse agents are conventionally used in warewashing applications to promote drying and to prevent the formation of spots. Even when both goals are accomplished, water solids filming is often evident. After a wash, rinse, and dry cycle, dishware, cups, glasses, etc., can exhibit filming that arises from the dissolved mineral salts common to all water supplies. Water solids filming is aesthetically unacceptable in most consumer and institutional environments.

Water solids filming on cookware, dishware and flatware is a particular problem in the presence of high solids containing water. In general, rinse waters containing in excess of 200 ppm total dissolved solids (TDS) tends to leave a visible film on glass and flatware after they are dried. Above 400 ppm, the films become objectionable, and above 800 ppm, the films are particularly aesthetically unacceptable. The TDS content can be reduced by a demineralization process, such as reverse osmosis, which can be expensive.

In order to reduce the formation of spotting, rinse agents have commonly been added to water to form an aqueous rinse that is sprayed on the dishware after cleaning is complete. The precise mechanism through which rinse agents work is not established. One theory holds that the surfactant in the rinse agent is absorbed on the surface at temperatures at or above its cloud point, and thereby reduces the solid-liquid interfacial energy and contact angle. This leads to the formation of a continuous sheet which drains evenly from the surface and minimizes the formation of spots. Generally, high foaming surfactants have cloud points above the temperature of the rinse water, and, according to this theory, would not promote sheet formation, thereby resulting in spots. Moreover, high foaming materials are known to interfere with the operation of warewashing machines. Common rinse aid formulations used in warewashing machines are used in an amount of less than about 1,000 parts, commonly 10 to 200 parts per million of active materials in the aqueous rinse. Rinse agents available in the consumer and institutional markets include liquid or solid forms that are typically added to, dispersed or dissolved in water to form an aqueous rinse. Such dissolution can occur from a rinse agent installed onto the dish rack. The rinse agent can be diluted and dispensed from a dispenser mounted on or in the machine or from a separate dispenser that is mounted separately but cooperatively with the dish machine.

Many commercial rinse agents include polyalkylene oxide copolymers and ethylene oxide/propylene oxide block copolymers. In such materials, the ethylene oxide block tends to be hydrophilic while the propylene oxide blocks tend to be hydrophobic producing a separation of hydrophilic and hydrophobic groups on the surfactant molecule. Surfactants can be formed by reacting an alcohol, a glycol, a carboxylic acid, an amine or a substituted phenol with various proportions and combinations of ethylene oxide and propylene oxide to form both random and block copolymers.

Exemplary rinse agent compositions are described by U.S. Pat. No. 5,589,099 to Baum; U.S. Pat. No. 5,447,648 to Steindorf; U.S. Pat. No. 5,739,099 to Welch et al.; U.S. Pat. No. 5,712,244 to Addison et al.; U.S. Pat. No. 5,545,352 to Pike; U.S. Pat. No. 5,273,677 to Arif; and U.S. Pat. No. 5,516,452 to Welch et al.

SUMMARY OF THE INVENTION

A rinse agent composition is provided according to the invention. The rinse agent composition includes a sheeting agent for promoting draining of sheets of water from a surface, and a humectant. The weight ratio of the humectant to the sheeting agent is preferably greater than about 1:3 and more preferably between about 5:1 and about 1:3.

Sheeting agents which can be used according to the invention include surfactants which provide a sheeting effect on a substrate and which, when used with the humectant, provide reduced water solids filming in the presence of high solids containing water compared with a composition not containing the humectant. That is, the sheeting agent promotes draining of sheets of water from a surface to promote drying. Exemplary sheeting agents which can be used in the rinse agent composition according to the invention include nonionic block copolymers having ethylene oxide and propylene oxide residues, alcohol alkoxylates, alkyl polyglycosides, zwitterionics, anionics, and mixtures thereof.

Humectants that can be used according to the invention include those materials that contain greater than 5 wt. percent water when the humectant is equilibrated at 50% relative humidity and room temperature. Exemplary humectants that can be used according to the invention include glycerine, propylene glycol, sorbitol, alkyl polyglycosides, polybetaine polysiloxanes, and mixtures thereof. It is understood that certain sheeting agents may fit the definition of a humectant according to the invention. Similarly, certain humectants may be considered sheeting agents. For purposes of determining the weight ratio of humectant to sheeting agent, it should be understood that the humectant and the sheeting agent for a particular rinse agent composition are different.

A method for rinsing a substrate surface in the presence of high solids containing water is provided according to the invention. The method includes a step of applying an aqueous rinse agent composition to a substrate surface. The rinse agent composition according to the invention is particularly useful for reducing the appearance of water solids filming caused by rinse waters containing in excess of 200 ppm total dissolved solids. The method preferably includes a step of cleaning the substrate surface prior to the step of rinsing.

DETAILED DESCRIPTION OF THE INVENTION

The invention relates to a rinse agent composition that includes a sheeting agent and a humectant. The sheeting agent is provided in an amount sufficient to improve the sheeting properties of the rinse agent composition. Sheeting properties refer to the ability of the rinse agent composition to form a continuous film or sheet on a substrate which promotes a continuous, even draining film of water and which leaves virtually no spots upon evaporation of the remaining water. In general, the presence of an unacceptable amount of spots on a substrate surface reflects the presence of an insufficient amount of sheeting agent according to the invention. The humectant is provided in an amount sufficient to reduce the visibility of a film on the substrate surface. The visibility of a film on substrate surface is a particular concern when the rinse water contains in excess of 200 ppm total dissolved solids. Accordingly, the humectant is provided in an amount sufficient to reduce the visibility of a film on a substrate surface when the rinse water contains in excess of 200 ppm total dissolved solids compared to a rinse agent composition not containing the humectant. The terms "water solids filming" or "filming" refer to the presence of a visible, continuous layer of matter on a substrate surface that gives the appearance that the substrate surface is not clean.

The rinse agent composition can additionally include defoamers, chelating agents, preservatives, stabilizers, processing aids, corrosion inhibitors, dyes, fillers, optical brighteners, germicides, pH adjusting agents, bleaches, bleach activators, perfumes, and the like.

The rinse agent composition can be referred to more simply as the rinse agent. The rinse agent can be provided as a concentrate or as a use solution. In addition, the rinse agent concentrate can be provided in a solid form or in a liquid form. In general, it is expected that the concentrate will be diluted with water to provide the use solution that is then supplied to the surface of a substrate. The use solution preferably contains an effective amount of active material to provide reduced water solids filming in high solids containing water. It should be appreciated that the term "active materials" refers to the nonaqueous portion of the use solution that functions to reduce spotting and water solids filming. More preferably the use solution contains less than 1,000 ppm and even more preferably between 10 ppm and 500 ppm of active materials.

It is believed that the rinse agent composition of the invention can be used in a high solids containing water environment in order to reduce the appearance of a visible film caused by the level of dissolved solids provided in the water. In general, high solids containing water is considered to be water having a total dissolved solids (TDS) content in excess of 200 ppm. In certain localities, the service water contains a total dissolved solids content in excess of 400 ppm, and even in excess of 800 ppm. The applications where the presence of a visible film after washing a substrate is a particular problem includes the restaurant or warewashing industry, the car wash industry, and the general cleaning of hard surfaces. Exemplary articles in the warewashing industry that can be treated with a rinse agent according to the invention include dishware, cups, glasses, flatware, and cookware. For the purposes of this invention, the terms "dish" and "ware" are used in the broadest sense to refer to various types of articles used in the preparation, serving, consumption, and disposal of food stuffs including pots, pans, trays, pitchers, bowls, plates, saucers, cups, glasses, forks, knives, spoons, spatulas, and other glass, metal, ceramic, plastic composite articles commonly available in the institutional or household kitchen or dining room. In general, these types of articles can be referred to as food or beverage contacting articles because they have surfaces which are provided for contacting food and/or beverage. In the car wash industry, filming on the surface of a washed motor vehicle is undesirable. Accordingly, the rinse agent is particularly useful for the glass and painted surfaces of a motor vehicle. Accordingly, the rinse agent composition according to the invention can be used to reduce the occurrence of visible filming caused by high solids containing water. Exemplary hard surfaces include glass, vehicle exteriors, ware, counter tops, light fixtures, windows, mirrors, plastics, clear coats, painted surfaces including painted metal and painted wood, and treated surfaces including treated metal and treated wood.

When used in warewashing applications, the rinse agent should provide effective sheeting action and low foaming properties. In car washing applications, it is desirable for the rinse to provide effective sheeting action. Rinse agents used for rinsing motor vehicles can tolerate a higher level of foaming than rinse agents used in warewashing machines.

The sheeting agent component of the rinse agent can be any surfactant which provides a desired level of sheeting action and which, when combined with the humectant, provides a rinse agent composition that controls the appearance of water solids on the surface of rinsed articles in the presence of high solids containing water. Exemplary sheeting agents that can be used according to the invention include nonionic block copolymers, alcohol alkoxylates, alkyl polyglycosides, zwitterionics, anionics, and mixtures thereof.

Exemplary nonionic block copolymer surfactants include polyoxyethylene-polyoxypropylene block copolymers. Exemplary polyoxyethylene-polyoxypropylene block copolymers that can be used have the formulae:

$$(EO)_x(PO)_y(EO)_x$$

$$(PO)_y(EO)_x(PO)_y$$

$$(PO)_y(EO)_x(PO)_y(EO)_x(PO)_y$$

wherein EO represents an ethylene oxide group, PO represents a propylene oxide group, and x and y reflect the average molecular proportion of each alkylene oxide monomer in the overall block copolymer composition. Preferably, x is from about 10 to about 130, y is about 15 to about 70, and x plus y is about 25 to about 200. It should be understood that each x and y in a molecule can be different. The total polyoxyethylene component of the block copolymer is preferably at least about 20 mol- % of the block copolymer and more preferably at least about 30 mol- % of the block copolymer. The material preferably has a molecular weight greater than about 1,500 and more preferably greater than about 2,000. Although the exemplary polyoxyethylene-polyoxypropylene block copolymer structures provided above have 3 blocks and 5 blocks, it should be appreciated that the nonionic block copolymer surfactants according to the invention can include more or less than 3 and 5 blocks. In addition, the nonionic block copolymer surfactants can include additional repeating units such as butylene oxide repeating units. Furthermore, the nonionic block copolymer surfactants that can be used according to the invention can be characterized heteric polyoxyethylene-polyoxypropylene block copolymers.

A desirable characteristic of the nonionic block copolymers used in the rinse agent of the invention is the cloud point of the material. The cloud point of nonionic surfactant of this class is defined as the temperature at which a 1 wt-% aqueous solution of the surfactant turns cloudy when it is heated.

BASF, a major producer of nonionic block copolymers in the United States recommends that rinse agents be formulated from nonionic EO-PO sheeting agents having both a low molecular weight (less than about 5,000) and having a cloud point of a 1 wt- % aqueous solution less than the typical temperature of the aqueous rinse. It is believed that one skilled in the art would understand that a nonionic surfactant with a high cloud point or high molecular weight would either produce unacceptable foaming levels or fail to provide adequate sheeting capacity in a rinse aid composition.

There are two general types of rinse cycles in commercial warewashing machines. A first type of rinse cycle can be referred to as a hot water sanitizing rinse cycle because of the use of generally hot rinse water (about 180° F.). A second type of rinse cycle can be referred to as a chemical sanitizing rinse cycle and it uses generally lower temperature rinse water (about 120° F.). A surfactant useful in these two conditions is an aqueous rinse having a cloud point less than the rinse water. Accordingly, the highest useful cloud point, measured using a 1 wt- % aqueous solution, for the nonionics of the invention point is approximately 80° C. The cloud point can be 50° C., 60° C., 70° C., or 80° C., depending on the use locus water temperature.

The alcohol alkoxylate surfactants that can be used or sheeting agents according to the invention preferably have the formula:

$$R(AO)_x—X$$

wherein R is an alkyl group containing 6 to 18 carbon atoms, AO is an alkylene oxide group containing 2 to 12 carbon atoms, x is 1 to 20, and X is hydrogen or an alkyl group containing 1–12 carbon atoms. The alkylene oxide group is preferably ethylene oxide, propylene oxide, butylene oxide, or mixture thereof. In addition, the alkylene oxide group can include a decylene oxide group as a cap.

The alkyl polyglycoside surfactants which can be used as sheeting agents according to the invention preferably have the formula:

$$(G)_x—O—R$$

wherein G is a moiety derived from reducing saccharide containing 5 or 6 carbon atoms, e.g., pentose or hexose, R is a fatty aliphatic group containing 6 to 20 carbon atoms, and x is the degree of polymerization (DP) of the polyglycoside representing the number of monosaccharide repeating units in the polyglycoside. Preferably, x is about 0.5 to about 10. Preferably, R contains 10–16 carbon atoms and x is 0.5 to 3.

The zwitterionic surfactants which can be used as sheeting agents that can be used according to the invention include β-N-alkylaminopropionates, N-alkyl-β-iminodipropionates, imidazoline carboxylates, N-alkylbetaines, sulfobetaines, sultaines, amine oxides and polybetaine polysiloxanes. Preferred polybetaine polysiloxanes have the formula:

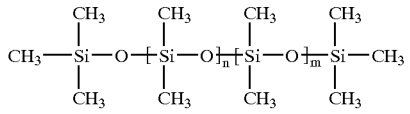

wherein R is

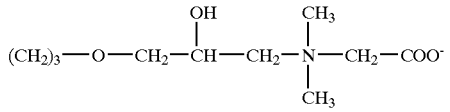

n is 1 to 100 and m is 0 to 100, preferably 1 to 100. Preferred polybetaine polysiloxanes are available under the name ABIL® from Goldschmidt Chemical Corp. Preferred amine oxides that can be used include alkyl dimethyl amine oxides containing alkyl groups containing 8 to 18 carbon atoms. A preferred amine oxide is lauryl dimethylamine oxide.

The anionic surfactants that can be used as sheeting agents according to the invention include carboxylic acid salts, sulfonic acid salts, sulfuric acid ester salts, phosphoric and polyphosphoric acid esters, perfluorinated anionics, and mixtures thereof. Exemplary carboxylic acid salts include sodium and potassium salts of straight chain fatty acids, sodium and potassium salts of coconut oil fatty acids, sodium and potassium salts of tall oil acids, amine salts, sarcosides, and acylated polypeptides. Exemplary sulfonic acid salts include linear alkylbenzenesulfonates, $C_{13}$–$C_{15}$ alkylbenzenesulfonates, benzene cumenesulfonates, toluene cumenesulfonates, xylene cumenesulfonates, ligninsulfonates, petroleum sulfonates, N-acyl-n-alkyltaurates, paraffin sulfonates, secondary n-alkanesulfonates, alpha-olefin sulfonates, sulfosuccinate esters, alkylnaphthalenesulfonates, and isethionates. Exemplary sulphuric acid ester salts include sulfated linear primary alcohols, sulfated polyoxyethylenated straight-chain alcohols, and sulfated triglyceride oils.

Exemplary surfactants which can be used as sheeting agents according to the invention are disclosed in Rosen, Surfactants and Interfacial Phenomena, second edition, John Wiley & sons, 1989, the entire document being incorporated herein by reference.

A humectant is a substance having an affinity for water. Humectants that can be used according to the invention are those materials that contain greater than 5 wt. % water (based on dry humectant) equilibrated at 50% relative humidity and room temperature. Exemplary humectants that can be used according to the invention include glycerin, propylene glycol, sorbitol, alkyl polyglycosides, polybetaine polysiloxanes, and mixtures thereof. The alkyl polyglycosides and polybetaine polysiloxanes that can be used as humectants include those described previously as sheeting agents. The rinse agent composition of the invention preferably includes humectant in an amount of at least 5 wt. % based on the weight of the concentrate. Preferably, the humectant is provided at between about 5 wt. % and about 75 wt. % based on the weight of the concentrate.

The rinse agent preferably includes a weight ratio of humectant to sheeting agent of greater than 1:3 and preferably between about 5:1 and about 1:3. It should be appreciated that the characterization of the weight ratio of humectant to sheeting agent indicates that the lowest amount of humectant to sheeting agent is 1:3 and that more humectant to sheeting agent can be used. More preferably, the weight ratio of humectant to sheeting agent is between about 4:1 and 1:2, and more preferably 3:1 to 1:1. Preferably the sheeting agent and the humectant are not the same chemical molecule for a particular rinse agent composition. Although alkyl polyglycosides and polybetaine polysiloxanes are identified as both sheeting agents and humectants, it should be understood that the rinse agent composition according to the invention preferably does not have a particular alkyl polyglycoside functioning as both the sheeting agent and the humectant, and preferably does not have a specific polybetaine polysiloxane functioning as the sheeting agent and the humectant in a particular rinse agent composition. It should be understood, however, that different alkyl polyglycosides or different polybetaine polysiloxanes can be used as sheeting agents and humectants in a particular rinse agent composition.

It is understood that certain components that are characterized as humectants in this application have been used in prior rinse agent compositions as, for example, processing aids, hydrotropes, solvents, and auxiliary components. In those circumstances, it is believed that the component has not been used in an amount or in environment that provides for reducing water solids filming in the presence of high solids containing water.

The rinse agent composition according to the invention can include complexing or chelating agents that aid in reducing the harmful effects of hardness components in service water. Typically, calcium, magnesium, iron, manganese, or other polyvalent metal cations, present in service water, can interfere with the action of either washing compositions or rinsing compositions. A chelating agent can be provided for complexing with the metal cation and preventing the complexed metal cation from interfering with the action of an active component of the rinse agent. Both organic and inorganic chelating agents are common. Inorganic chelating agents include such compounds as sodium pyrophosphate, and sodium tripolyphosphate. Organic chelating agents include both polymeric and small molecule chelating agents. Polymeric chelating agents commonly comprise ionomer compositions such as polyacrylic acids compounds. Small molecule organic chelating agents include salts of ethylenediaminetetracetic acid (EDTA) and hydroxyethylenediaminetetracetic acid, nitrilotriacetic acid, ethylenediaminetetrapropionates, triethylenetetraminehexacetates, and the respective alkali metal ammonium and substituted ammonium salts thereof. Phosphonates are also suitable for use as chelating agents in the composition of the invention and include ethylenediamine tetra(methylenephosphonate), nitrilotrismethylenephosphonate, diethylenetriaminepenta(methylene phosphonate), hydroxyethylidene diphosphonate, and 2-phosphonobutane-1,2,4-tricarboxylic acid. Preferred chelating agents include the phosphonates. These phosphonates commonly contain alkyl or alkylene groups with less than 8 carbon atoms.

Optional ingredients which can be included in the rinse agents of the invention in conventional levels for use include solvents, hydrotropes, processing aids, corrosion inhibitors, dyes, fillers, optical brighteners, germicides, pH adjusting agents (monoethanolamine, sodium carbonate, sodium hydroxide, hydrochloric acid, phosphoric acid, et cetera), bleaches, bleach activators, perfumes and the like.

The rinse agent according to the invention can be provided as a solid or as a liquid. When the rinse agent is provided as a liquid, it is expected that the composition will have a liquid base component that functions as a carrier and cooperates with aqueous diluents to form an aqueous rinse agent. Exemplary liquid bases include water and solvents compatible with water to obtain compatible mixtures.

The rinse agent of the invention can be formulated using conventional formulating equipment and techniques. The liquid rinse agent according to the invention can include the amounts of components identified in Table 1.

Liquid rinse agents according to the invention can be manufactured in commonly available mixing equipment by charging to a mixing chamber the liquid diluent or a substantial proportion of a liquid diluent. Into a liquid diluent is added preservatives or other stabilizers. Care must be taken in agitating the rinse agent as the formulation is completed to avoid degradation of polymer molecular weight or exposure of the composition to elevated temperatures. The materials are typically agitated until uniform and then packaged in commonly available packaging and sent to distribution center before shipment to the consumer.

TABLE 1

Liquid Rinse Agent Proportions

| | Useful | Preferred | Most Preferred |
|---|---|---|---|
| Sheeting Agent | 0.1–50 | 5–40 | 10–30 |
| Humectant | 5–75 | 7–60 | 10–50 |
| Preservative | 0–1 | 0.01–0.5 | 0.025–0.2 |
| Diluent | Balance | Balance | Balance |

The liquid materials of the invention can be adapted to a cast solid format by incorporating into the composition a casting agent. Typically organic and inorganic solidifying materials can be used to render the composition solid. Preferably organic materials are used because inorganic compositions tend to promote filming in a rinse cycle. The most preferred casting agents are polyethylene glycol and an inclusion complex comprising urea and a nonionic polyethylene or polypropylene oxide polymer. Polyethylene glycols (PEG) are used in melt type solidification processing by uniformly blending the sheeting agent and other components with PEG at a temperature above the melting point of the PEG and cooling uniform mixture. An inclusion complex solidifying scheme is set forth in Morganson et al., U.S. Pat. No. 4,647,258.

The solid compositions of the invention are set forth in Table 2 as follows:

TABLE 2

Solid Rinse Agent Proportions (wt-%)

| | Useful | Preferred | Most Preferred |
|---|---|---|---|
| Sheeting Agent | 0.1–90 | 5–85 | 10–80 |
| Humectant | 5–75 | 7–60 | 10–50 |
| Preservative | 0.001–1 | 0.01–0.5 | 0.025–0.2 |
| Solidifying System | 0–40 | 0.1–35 | 0.5–35 |
| Diluent | Balance | Balance | Balance |

Liquid rinse agents of the invention are typically dispensed by incorporating compatible packaging containing the liquid material into a dispenser adapted to diluting the liquid with water to a final use concentration wherein the active materials (sheeting agent and humectant) is present in the aqueous rinse at a concentration of 10 to 500 parts per million parts of the aqueous rinse. More preferably the material is present in the aqueous rinse at a concentration of about 10 to 300 parts per million parts of the aqueous rinse, and most preferably the material is present at a concentration of about 10 to 200 parts per million parts of the aqueous rinse. Examples of dispensers for the liquid rinse agent of the invention are DRYMASTER-P sold by Ecolab Inc., St. Paul, Minn. Cast solid products may be conveniently dispensed by inserting a cast solid material in a container or with no enclosure into a spray-type dispenser such as the volume SOL-ET controlled ECOTEMP Rinse Injection Cylinder system manufactured by Ecolab Inc., St. Paul, Minn. Such a dispenser cooperates with a warewashing machine in the rinse cycle. When demanded by the machine, the dispenser directs a spray of water onto the cast solid block of rinse agent which effectively dissolves a portion of the block creating a concentrated aqueous rinse solution which is then fed directly into the rinse water forming the aqueous rinse. The aqueous rinse is then contacted with the dishes to affect a complete rinse. This dispenser and other similar dispensers are capable of controlling the effective concentration of the active portion in the aqueous rinse by measuring the volume of material dispensed, the actual concentration of the material in the rinse water (an electrolyte measured with an electrode) or by measuring the time of the spray on the cast block. In general, the concentration of active portion in the aqueous rinse is preferably the same as identified above for liquid rinse agents.

In the case of a concentrate for a car wash application, the rinse agent concentrate preferably includes: 26.5 wt. % of water, 15 wt. % lauryl dimethylamine oxide (30% active), 20 wt. % alkyl polyglycoside (70% active) available under the name Triton BG-10, 15 wt. % lauryl polyglycoside (50% active) available under the name Glucopon 625UP, 3.5 wt. % phosphono butane carboxylic available under the name Dequest 2000, and 20 wt. % sodium xylene sulphonate (40% active). This concentrate includes alkyl polyglycoside as both a sheeting agent and as a humectant.

The following examples and data further illustrate the practice of the invention, should not be taken as limiting the invention and contains the best mode. The following examples and data show the effectiveness of the invention in promoting adequate rinsing.

EXAMPLE 1

High solids containing water was provided containing 600 ppm total dissolved solids. The water included 300 ppm TDS softened water with an additional 300 ppm added sodium chloride. The temperature of the water was provided at 170° F., and a rinse agent concentration of 0.5 ml of the composition described in Table 3 per 1.2 gallons water was provided. In order to demonstrate the effectiveness of the rinse agent compositions, 8 ounce clean libby tumblers were dipped in the water solution for 45 seconds. The tumblers were removed and placed inverted on a dish machine flat rack, and allowed to drain and dry at room temperatures. The tumblers were graded after standing overnight. The tumblers were graded for film on a 1 to 5 scale, with one being completely clean and 5 being filmed to a degree as achieved with a conventional rinse agent. The grading was completed in a laboratory "light box" with light directed both at the glass from above and below. The grading scale is provided as follows:

| | |
|---|---|
| 1 | No visible film |
| 2 | Barely visible film |
| 3 | Moderate film |
| 4 | Heavy film |
| 5 | Severe film |

Compositions 1–7 were tested as rinse agent use solutions. The components of each composition and the results of the example are reported in Table 3.

TABLE 3

| Component | 1 | 2 | 3 | 4 | 5 | 6 | 7 |
|---|---|---|---|---|---|---|---|
| Citric Acid 100% | 10.0 | — | — | — | — | — | — |
| Propylene Glycol | — | 20.0 | 10.0 | — | — | 20.0 | 30.0 |
| Glycerine 96% | — | — | 10.0 | 25.0 | 15.0 | — | — |
| Bayhibit AM* | 7.2 | 7.2 | 7.2 | 7.2 | 7.2 | 7.2 | 7.2 |
| EO PO Block Polymer 39% EO | 25.0 | 25.0 | 25.0 | 25.0 | 25.0 | 25.0 | 25.0 |
| EO PO Block Polymer 32% EO | 9.0 | 9.0 | 9.0 | 9.0 | 9.0 | 9.0 | 9.0 |
| Water and Inerts to 100% | | | | | | | |
| Results using Soft Water w/NaCl @ 170° F. | 5 | 3.5 | 2.5 | 3.5 | 2.5 | 3.0 | 3.0 |

*Bayhibit AM is a 50% solution of 2-phosphonobutane-1,2,4-tricarboxylic acid.

Results show that compositions 2–7 perform substantially better at reducing water solids filming than composition 1 which does not include humectant.

EXAMPLE 2

A further test was conducted using 8-ounce Libby tumblers dipped into softened water and softened water with an additional 300-ppm added sodium chloride. The procedure for this test is the same as reported in example 1. Rinse agent compositions 8–11 and the test results are reported in Table 4.

TABLE 4

| Component | 8 | 9 | 10 | 11 |
|---|---|---|---|---|
| Hexylene Glycol | 30.0 | — | — | — |
| Propylene Glycol | — | — | 30.0 | 30.0 |
| Sorbitol 70% | — | 30.0 | — | — |
| Bayhibit AM | 7.2 | 7.2 | 7.2 | 7.2 |
| EO PO Block Polymer 39% EO | 10.1 | 10.1 | 10.1 | 10.1 |
| EO PO Block Polymer 32% EO | 3.6 | 3.6 | 3.6 | 3.6 |
| Water and Inerts to 100% | — | — | — | — |
| results using soft Water @ 170° F. | 3.5 | 3.0 | 2.5 | 2.5 |
| results using soft Water w/NaCl @ 170° F. | 5.0 | 4.0 | 3.5 | 3.5 |

The results demonstrate that compositions 10 and 11, with propylene glycol, perform better at reducing water solids filming than the compositions with either Sorbitol or hexylene glycol.

EXAMPLE 3

Another test was completed in which the 8-ounce Libby tumblers were dipped into softened water and softened water with an additional 300 ppm added sodium chloride. The procedure for this test is the same as reported in example 1, with the exception of additional tests for some formulations at ambient temperature to simulate non-autodish applications such as vehicle wash and parts washing. The tested compositions and test results are provided in Table 5.

TABLE 5

| Component | 12 | 13 | 14 | 15 | 16 | 17 | 18 | 19 | 20 | 21 | 22 |
|---|---|---|---|---|---|---|---|---|---|---|---|
| Propylene Glycol | 30.0 | — | 30.0 | 30.0 | — | — | 30.0 | — | — | 30.0 | — |
| Dehypon LS-54 | 13.72 | 13.72 | — | — | — | — | — | — | — | — | — |
| AG6202 | | 30.0 | 13.72 | — | 13.72 | — | — | — | — | — | — |
| LAS Acid | — | — | — | — | — | 10.6 | 10.6 | 10.6 | — | — | — |
| KOH, 45% | — | — | — | — | — | 3.12 | 3.12 | 3.12 | — | — | — |
| Miranol FBS | — | — | — | — | — | — | — | — | 13.72 | 13.72 | 13.72 |
| Glucopon 225 | — | — | — | 13.72 | 30.0 | — | — | 30.0 | — | — | 30.0 |
| Bayhibit AM | 7.2 | 7.2 | 7.2 | 7.2 | 7.2 | 7.2 | 7.2 | 7.2 | 7.2 | 7.2 | 7.2 |
| Water and Inerts to 100% | | | | | | | | | | | |
| results for soft water @ 170° F. | 1.5 | 1.0 | 1.5 | 1.0 | 1.0 | 3.0 | 2.0 | 2.0 | 2.0 | 2.0 | 1.5 |
| results for soft water w/NaCl @ 170° F. | 3.5 | 2.5 | 3.5 | 2.0 | 3.5 | 3.5 | 3.5 | 2.5 | 3.0 | 3.0 | 1.5 |
| results for soft water with NaCl @ Ambient temp | — | — | — | — | — | 3.0 | 3.0 | 3.0 | 3.0 | 3.0 | 1.0 |

Results show that this invention is not limited to the use of EO PO block polymers with a humectant. Other types of surfactants, such as alcohol alkoxylates (such as Dehypon LS-54), alkyl polyglycosides (such as AG 6202 and Glucopon 225), zwitterionics (such as Miranol FBS), and anionics (such as LAS), together with a humectant, can produce the desired results.

Results also show that some surfactants that are highly hydratable, such as, alkyl polyglycosides and polybetaine polysiloxanes, can act as humectants. Composition 22, with a polyglycoside as the humectant, provides the best results.

Results also show that this invention can be practiced at temperatures other than the elevated temperatures used in warewashing applications. Compositions 17–22 were tested at ambient temperature and provide excellent results. Other applications include, but are not limited to, vehicle wash and parts washing.

EXAMPLE 4

Composition 19 was tested in a commercial conveyor-type car wash station. The process included a "prep" step, followed by a "wash" step, followed by a "flush" step, followed by a "wax/rinse" step, followed by a "blow-dry" step, then finally by a "hand wipe" step. Composition 19 was tested in the "wax/rinse" step. Concentrations tested varied from ~800 to ~70 ppm. The results confirmed the desired sheeting and humectancy effects of composition 19. Even after wiping with wet towels, the surface of the cars maintained a thin sheet of water for a long time before it dried evenly, reducing spots and film and resulting in a nice shiny final appearance.

EXAMPLE 5

Composition 19 was tested in a commercial in-bay-automatic-type car wash station. The process included a "wash" step, followed by a "rinse" step, relying on the carry-over to provide sheeting and drying. The water conditions at the car wash facility were about 150 ppm TDS and 4 grains water hardness. The use of the in-line commercial product resulted in lots of spots and film, mostly on glass. With the use of composition 19, the results were improved on both the glass and paint; spots and film were not as visible.

EXAMPLE 6

Composition 22 was tested in a glass cleaning application and compared with a commercial glass cleaner available under the name Oasis 256 from Ecolab Inc. Both composition 22 and the commercial glass cleaner were diluted with high TDS hard water (hard water with the addition of 300 ppm NaCl). Both were tested at 24 ounce/gallon. The results showed that composition 22 left significantly less spots and streaks and film from the TDS and water hardness after drying, compared with the commercial glass cleaner.

EXAMPLE 7

This example illustrates the humectancy of several humectants. Glucopon 225, Glucopon 600, propylene glycol, a mixture containing 50 wt. % propylene glycol and 50 wt. % water, and ABIL 9950. The humectancy test was conducted in a humidity chamber set at 50% relative humidity and a temperature of 26.7° C. The results of each test is reported below.

Glucopon 225

| Date | Initial Weight | Weight of Product | Total Weight Loss | % Weight Loss |
|---|---|---|---|---|
| Beaker | 62.43 | 23.89 | | |
| Beaker + Product Feb. 08, 2000 | 86.32 | | | |
| Beaker + Product Feb. 09, 2001 | 85.18 | 22.75 | 1.1400 | 4.77187 |
| Beaker + Product Feb. 11, 2000 | 84.38 | 21.95 | 1.9400 | 8.12055 |
| Beaker + Product Feb. 14, 2000 | 83.98 | 21.55 | 2.3400 | 9.79489 |
| Beaker + Product Feb. 18, 2000 | 83.71 | 21.28 | 2.6100 | 10.92507 |
| Beaker + Product Feb. 21, 2000 | 83.65 | 21.22 | 2.6700 | 11.17622 |
| Beaker + Product Mar. 03, 2000 | 83.69 | 21.26 | 2.6300 | 11.00879 |
| Beaker + Product Mar. 08, 2000 | 83.63 | 21.20 | 2.6900 | 11.25994 |
| Beaker + Product Mar. 09, 2000 | 83.62 | 21.19 | 2.7000 | 11.30180 |
| Beaker + Product Mar. 13, 2000 | 83.65 | 21.22 | 2.6700 | 11.17622 |
| Beaker + Product Mar. 14, 2000 | 83.64 | 21.21 | 2.6800 | 11.21808 |
| Beaker + Product Mar. 15, 2000 | 83.62 | 21.19 | 2.7000 | 11.30180 |
| Beaker + Product Mar. 22, 2000 | 83.59 | 21.16 | 2.7300 | 11.42738 |

Glucopon 600

| Date | Initial Weight | Weight of Product | Total Weight Loss | % Weight Loss |
|---|---|---|---|---|
| Beaker | 99.8 | 14.14 | | |
| Beaker + Product Feb. 08, 2000 | 113.94 | | | |
| Beaker + Product Feb. 09, 2001 | 108.72 | 8.94 | 5.2200 | 36.91655 |
| Beaker + Product Feb. 11, 2000 | 108.31 | 8.51 | 5.6300 | 39.81612 |
| Beaker + Product Feb. 18, 2000 | 108.37 | 8.57 | 5.5700 | 39.39180 |
| Beaker + Product Mar. 03, 2000 | 108.36 | 8.56 | 5.5800 | 39.46252 |
| Beaker + Product Mar. 08, 2000 | 108.40 | 8.60 | 5.5400 | 39.17963 |
| Beaker + Product Mar. 09, 2000 | 108.38 | 8.58 | 5.5600 | 39.32107 |
| Beaker + Product Mar. 13, 2000 | 108.42 | 8.62 | 5.5200 | 39.03819 |
| Beaker + Product Mar. 14, 2000 | 108.42 | 8.62 | 5.5200 | 39.03819 |
| Beaker + Product Mar. 15, 2000 | 108.39 | 8.59 | 5.5500 | 39.25035 |
| Beaker + Product Mar. 22, 2000 | 108.39 | 8.59 | 5.5500 | 39.25035 |

Propylene Glycol

| Date | Initial Weight | Weight of Product | Total Weight Loss | % Weight Loss |
|---|---|---|---|---|
| Beaker | 126.33 | 23.54 | | |
| Beaker + Product Feb. 08, 2000 | 149.87 | | | |
| Beaker + Product Feb. 09, 2001 | 158.83 | 32.50 | −8.9600 | −38.−6287 |
| Beaker + Product Feb. 11, 2000 | 159.49 | 33.16 | −9.6200 | −40.86661 |
| Beaker + Product Feb. 14, 2000 | 158.77 | 32.44 | −8.9000 | −37.80799 |
| Beaker + Product Feb. 18, 2000 | 157.30 | 30.97 | −7.4300 | −31.56330 |
| Beaker + Product Feb. 21, 2000 | 154.27 | 27.94 | −4.4000 | −18.69159 |
| Beaker + Product Mar. 03, 2000 | 149.13 | 22.80 | 0.7400 | 3.14359 |
| Beaker + Product Mar. 08, 2000 | 146.61 | 20.28 | 3.2600 | 13.84877 |
| Beaker + Product Mar. 09, 2000 | 145.80 | 19.47 | 4.0700 | 17.28972 |
| Beaker + Product Mar. 13, 2000 | 143.94 | 17.61 | 5.9300 | 12.52308 |
| Beaker + Product Mar. 14, 2000 | 143.64 | 17.31 | 6.2300 | 12.27382 |
| Beaker + Product Mar. 15, 2000 | 142.36 | 16.03 | 7.5100 | 12.54624 |
| Beaker + Product Mar. 22, 2000 | 139.23 | 12.90 | 10.6400 | 13.14175 |

50% Propylene Glycol 50% Water

| Date | Initial Weight | Weight of Product | Total Weight Loss | % Weight Loss |
|---|---|---|---|---|
| Beaker | 124.11 | 24.43 | | |
| Beaker + Product Feb. 08, 2000 | 148.54 | | | |
| Beaker + Product Feb. 09, 2001 | 143.29 | 19.16 | 5.2500 | 21.48997 |
| Beaker + Product Feb. 11, 2000 | 140.91 | 16.80 | 7.6300 | 31.23209 |
| Beaker + Product Feb. 14, 2000 | 139.35 | 15.24 | 9.1900 | 37.61768 |
| Beaker + Product Feb. 18, 2000 | 137.40 | 13.29 | 11.1400 | 45.59967 |
| Beaker + Product Feb. 21, 2000 | 135.60 | 11.49 | 12.9400 | 52.96766 |
| Beaker + Product Mar. 03, 2000 | 131.06 | 6.95 | 17.4800 | 71.55137 |
| Beaker + Product Mar. 08, 2000 | 128.9 | 4.79 | 19.6400 | 80.39296 |
| Beaker + Product Mar. 09, 2000 | 128.41 | 4.30 | 20.1300 | 82.39869 |
| Beaker + Product Mar. 13, 2000 | 127.15 | 3.04 | 21.3900 | 87.55628 |
| Beaker + Product Mar. 14, 2000 | 126.68 | 2.77 | 21.6600 | 88.66148 |
| Beaker + Product Mar. 15, 2000 | 126.49 | 2.38 | 22.0500 | 90.25788 |
| Beaker + Product Mar. 22, 2000 | 124.72 | 0.61 | 23.8200 | 97.50307 |

ABIL 9950

| Date | Initial Weight | Weight of Product | Total Weight Loss | % Weight Loss |
|---|---|---|---|---|
| Beaker | 53.57 | 50.27 | | |
| Beaker + Product Mar. 08, 2000 | 103.84 | | | |
| Beaker + Product Mar. 09, 2000 | 104.39 | 50.82 | −0.5500 | −1.09409 |
| Beaker + Product Mar. 13, 2000 | 105.54 | 51.97 | −1.7000 | −3.38174 |
| Beaker + Product Mar. 14, 2000 | 104.98 | 51.41 | −1.1400 | −2.26775 |
| Beaker + Product Mar. 15, 2000 | 104.32 | 50.75 | −0.4800 | −0.95484 |
| Beaker + Product Mar. 22, 2000 | 103.60 | 50.03 | 0.2400 | 0.47742 |

Both the Glucopon 225 and Glucopon 600 held onto the water tenaciously and easily fit the criterion of a humectant. Both were 50% solutions and after extended storage in the 50% relative humidity chamber, Glucopon 225 retained about 38.6% water from the starting 50%, and Glucopon 600 retained about 10.8% water from the starting 50%. It is believed that Glucopon 225 functions better as a humectant compared with Glucopon 600 because of the higher number of glucose units.

The results for ABIL B9950 (a polybetaine polysiloxane) also support its being an excellent humectant. It was a 50% solution and, after extended storage in the 50% relative humidity chamber, it retained virtually all its starting 50% water.

Propylene glycol appears to have initially picked up water, but then the mixture appeared to have evaporated off as an azeotrope. This explanation is supported by the 50% propylene glycol/50% water results.

While the above description, examples, and data provides a basis for understanding the invention, the invention can be made in a variety of embodiments. The invention resides in the claims hereinafter appended.

We claim:

1. A rinse agent composition comprising:

(a) sheeting agent comprising nonionic block copolymer surfactant in an amount for promoting draining of sheets of water from a surface, wherein the nonionic block copolymer comprises ethylene oxide and propylene oxide units; and (b) humectant comprising glycerine or propylene glycol, wherein the humectant comprises a material that contains greater than 5 wt. % water when the humectant is equilibrated at 50% relative humidity and room temperature;

wherein the sheeting agent and the humectant are different and the weight ratio of the total amount of humectant in the rinse agent composition to the total amount of sheeting agent in the rinse agent composition is greater than 1:2, and wherein the rinse agent composition, when provided as an aqueous rinse containing an active materials concentration of 10 parts per million to 500 parts per million, reduces water solids filming in the presence of rinse water containing in excess of 200 parts per million total dissolved solids compared to an aqueous rinse not containing the humectant.

2. A rinse agent composition according to claim 1, further comprising a pH adjusting agent including citric acid.

3. A rinse agent composition according to claim 1, wherein the nonionic block copolymer further comprises a number average molecular weight of between about 1,500 and about 100,000.

4. A composition comprising:

(a) at least 10 wt. % sheeting agent comprising polyoxyethylene-polyoxypropylene block copolymer; and (b) at least 10 wt. % humectant comprising glycerine or propylene glycol, wherein the humectant comprises a material that contains greater than 5 wt. % water when the humectant is equilibrated at 50% relative humidity and room temperature;

wherein the weight ratio of the total amount of humectant to the total amount of sheeting agent is about 1:3 to about 1:1.

5. A composition according to claim 4, wherein the polyoxyethylene-polyoxypropylene block copolymer has a number average molecular weight of between about 1,500 and about 100,000.

6. A composition according to claim 4, wherein the polyoxyethylene-polyoxypropylene block copolymer has the formula:

$$(EO)_x(PO)_y(EO)_x$$

wherein EO is an ethylene oxide group, PO is a propylene oxide group, x is about 10 to about 130, y is about 15 to about 70, and x+y is about 25 to about 200.

7. A composition according to claim 4, wherein the polyoxyethylene-polyoxypropylene block copolymer has the formula:

$$(PO)_y(EO)_x(PO)_y$$

wherein EO is an ethylene oxide group, PO is a propylene oxide group, x is about 10 to about 130, y is about 15 to about 70, and x+y is about 25 to about 200.

8. A composition according to claim 4, wherein the polyoxyethylene-polyoxypropylene block copolymer has the formula:

$$(PO)_y(EO)_x(PO)_y(EO)_x(PO)_y$$

wherein EO is an ethylene oxide group, PO is a propylene oxide group, x is about 10 to about 130, y is about 15 to about 70, and x+y is about 25 to about 200.

9. A composition according to claim 4, wherein the composition comprises less than about 50 wt. % humectant.

* * * * *